US005400959A

United States Patent [19]

Cone

[11] Patent Number: 5,400,959

[45] Date of Patent: Mar. 28, 1995

[54] MAILBOX ASSEMBLY

[76] Inventor: Bruce B. Cone, 2801 Twelve Oaks, Edmond, Okla. 73003

[21] Appl. No.: 254,864

[22] Filed: Jun. 6, 1994

[51] Int. Cl.[6] ..... B65D 91/00

[52] U.S. Cl. ..... 232/39; 232/34

[58] Field of Search ..... 232/39, 17, 34; 248/900; 285/114, 117; 52/98, 726.1

[56] References Cited

U.S. PATENT DOCUMENTS

| | | | |
|---|---|---|---|
| 1,075,896 | 10/1913 | Boughner | 285/117 |
| 1,098,147 | 5/1914 | Greve | 285/117 |
| 1,118,726 | 11/1914 | Beecher | 285/117 |
| 1,188,485 | 6/1916 | Pruyn . | |
| 3,813,733 | 6/1974 | Flohr | 285/117 |
| 3,891,139 | 6/1975 | Redling | 232/17 |
| 4,498,621 | 2/1985 | Diamond | 232/39 |
| 4,549,332 | 10/1985 | Pouliot | 285/117 |
| 4,759,161 | 7/1988 | Kucyk, Jr. et al. | 52/99 |
| 4,792,088 | 12/1988 | Bonnell | 232/17 |
| 4,850,565 | 7/1989 | Moreno | 248/545 |
| 4,915,293 | 4/1990 | Paramski | 232/39 |
| 5,160,111 | 11/1992 | Hugron | 248/548 |

*Primary Examiner*—Michael J. Milano

*Attorney, Agent, or Firm*—Dougherty, Hessin, Beavers & Gilbert

[57] ABSTRACT

A mailbox assembly consisting of a mailbox and telescopically assembled sectional post wherein all members are constructed of high impact resistant plastic and all members are tethered together so that disassembled components may be readily reassembled to form the serviceable mailbox assembly.

7 Claims, 2 Drawing Sheets

MAILBOX ASSEMBLY

BACKGROUND OF THE INVENTION

1. Field of the Invention

The invention relates generally to rural-type mailbox assemblies and, more particularly, but not by way of limitation, it relates to an improved construction for a mailbox that enables increased resistance to destruction.

2. Description of the Prior Art

The prior art includes numerous types of rural delivery mailboxes, some of which have been known and employed since earliest times of mail delivery. A recent U.S. Pat. No. 4,759,161 provides teaching of a break-away support structure that utilizes a replaceable shear connector. Thus, when the mailbox is damaged by being hit by a vehicle or intentionally mauled, a frangible upright support linkage is adapted to retain the broken mailbox installation for reassembly and upright positioning. Another U.S. Pat. No. 4,792,088 teaches a mailbox that is supported on a spring linked support pole so that any horizontal force striking the mailbox will result in a relatively non-damaging blow as the mailbox is free to give way and reverberate on its spring support, and to return to its supported upright position.

Finally, a U.S. Pat. No. 5,160,111 teaches another type of frangible mailbox support post having a sector that is intentionally devised for breakage with components chain-tethered for subsequent reassembly. The post stanchion employs a sleeve part that includes spiral scores or grooves which allow breakage of the upright post with minimal damage to the mailbox components.

SUMMARY OF THE INVENTION

The present invention relates to an improvement in construction of a mailbox and mounting post, which improvements are largely directed to the materials and mode of manufacture that allow minimal damage and ready reassembly after destructive force strikes the mailbox. The mailbox and plural sectors of mounting post are formed, preferably by molding, of an extremely rugged yet resilient plastic compound. The mailbox includes a mounting collar which is snap-fit to the upper end of a mounting post that is comprised of a plurality of interconnecting post sections. A suitable tether or chain interconnects the mailbox through the mounting post to the lower post section and, in the event of destructive disassembly, the elements are retained for quick and easy reassembly to the upright mailbox position. The lowermost post section may preferably be set in concrete or the like to provide most secure positioning.

Therefore, it is an object of the present invention to provide a relatively indestructible mailbox and supporting mounting post.

It is also an object of the present invention to provide a mailbox and support that is constructed of highly resilient material that is resistant to damage from both automobiles and vandals.

It is yet further an object of the present invention to provide a mailbox and support post combination that will not rust and won't scratch or damage close-approaching automobiles.

Finally, it is an object of the present invention to provide a mailbox and supporting post that is aesthetically appealing yet relatively indestructible from exterior forces.

Other objects and advantages of the invention will be evident from the following detailed description when read in conjunction with the accompanying drawings which illustrate the invention.

DETAILED DESCRIPTION OF THE INVENTION

Figure 1:
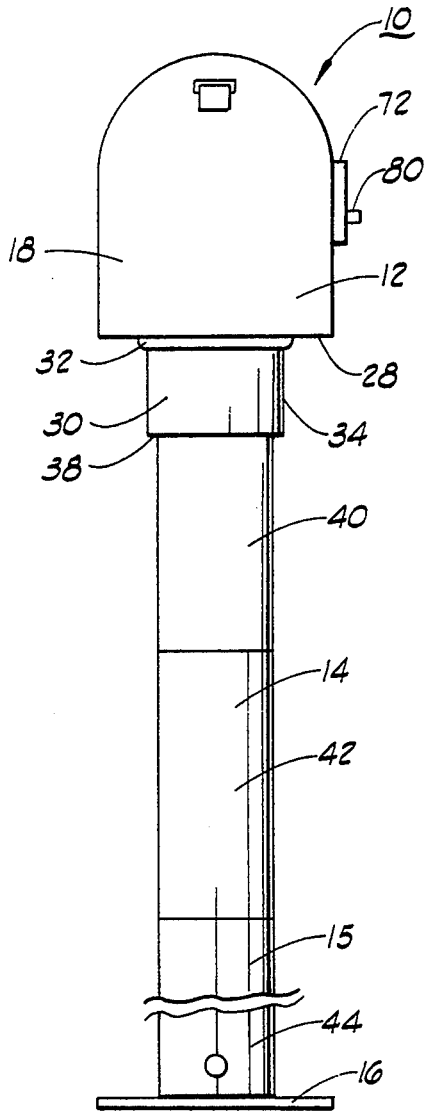
FIG. 1 is a front view in elevation of the mailbox assembly.
Figure 2:
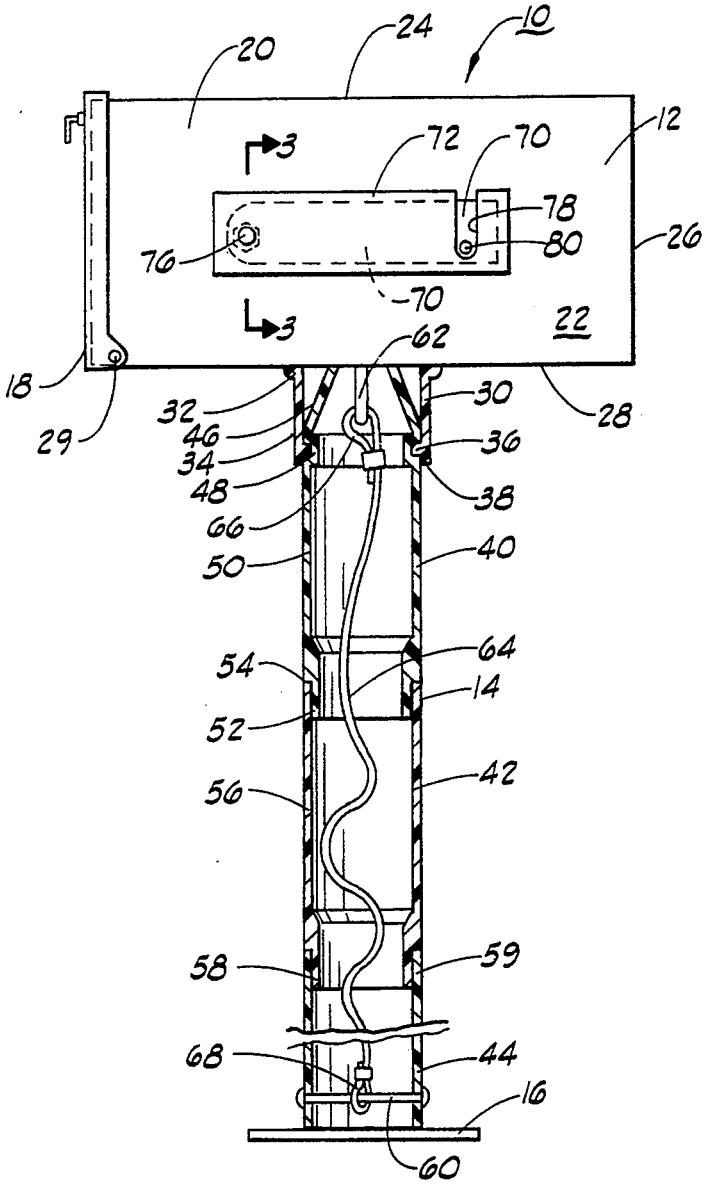
FIG. 2 side view in elevation of the assembly of FIG. 1 with the support post and mounting collar shown in vertical section.

Referring to FIGS. 1 and 2, a mailbox assembly 10 consists of a mailbox 12 as supported on an upright mounting post 14 that is adapted for secure positioning in the ground surface. A foot plate 16 is formed on the lower end of mounting post 14 to serve as an anchor member when the ground positioning is firmed with concrete. All components of the mailbox assembly 10 are preferably formed as plastic moldings utilizing a selected one of several commercially available plastic materials that are extremely strong yet allow limited stress bending and exhibit an exterior surface that is not likely to scratch any contacting metallic surfaces, e.g., auto fenders, doors or the like.

The mailbox 12 is of standard, traditional shape having a front door 18, an elongate housing 20 having sides 22 and top 24 which may be rounded in keeping with the traditional shape. Finally, a rear panel 26 and a rectangular bottom panel 28 complete the enclosure, mailbox 12.

A mounting collar 30 is secured at a middle point along the length of bottom panel 28 to provide a snap-fit fixture to the mounting post 14. The mounting collar 30 is preferably formed unitarily with mailbox 12; however, it may be affixed with a suitable plastic bonding agent between upper lip 32 and the bottom panel 28. A cylindrical side wall 34 is then formed to extend below upper lip 32, and side wall 34 includes further formation of an annular ring 36 around the interior for the purpose of engagement with mating groove of mounting post 14, as will be further described. The interior annular ring 36 is formed in spaced disposition upward from a lower lip 38 of mounting collar 30 further to aid in more secure snap-fit positioning. The mounting collar 30 and mounting post 14 may be formed from either round or square tubular stock; however, it is obvious that round formation will provide more effective break-away operation as regards the individual joint assemblies.

The mounting post 14 is formed from a succession of post sections such as upper post section 40, middle post section 42 (one or more) and lower post section 44 terminating in foot member 16. The upper post section 40 is formed to include a generally narrowing (frustum of a cone) upper end 46 that descends down to terminate at an annular groove 48 formed for mating engagement with annular ring 36 of mounting collar 30. A wall 50 then descends from annular groove 48 downward to formation of an inset 52 which is formed to be telescopically received firmly within the end 54 of wall 56 of the mid post section 42. Mid post section 42 is also formed such that side wall 56 descends to terminate below in an inset 58. The insets 52 and 58 on respective post sections 40 and 42 are formed by reducing the outside diameter to that matching the inside diameter of the next succeeding assembled piece.

Finally, an upper end 59 of bottom post section 44 is firmly received over the reduced diameter end 58 of mid post section 14. A retaining pin 60, a bolt, rivet pin or the like, is secured through the bottom end of lower post section 44 adjacent the anchor foot 16. A securing eye 62 is formed on the underside panel 28 of mailbox 12, and a tether 64 is secured between upper eye 62 and the securing pin 60 by means of respective connector loops 66 and 68. Sufficient slack is maintained in tether 64 to allow continuous interconnection of mailbox 12 and all sections of support post 14 even when wholly or partially disassembled. Tether 64 may be formed from a selected type of cable or chain.

Figure 3:
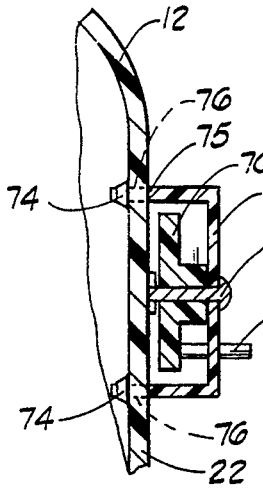
FIG. 3 is a vertical section taken along lines 3—3 of FIG. 2.
Figure 4:
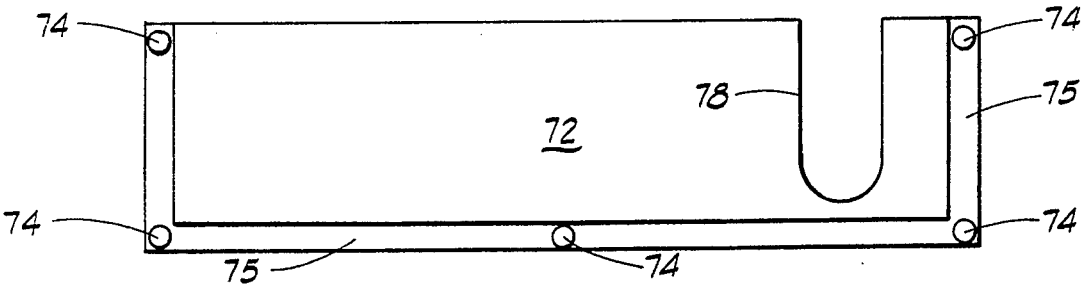
FIG. 4 is an inside plan view of a flag housing as used in FIG. 2.

Referring to FIG. 3, the mailbox 12 also includes provision for a movable flag 70 in traditional manner. An elongated, rectangular flag housing 72 is snap-fit onto one side 22 of mailbox 12. The preferred form of affixture or snap-fit is the force fit of arrow inserts 74 through mating holes 76, a plurality of six or eight such fasteners. Thus, the flag housing 72 is provided on the mailbox side 22 as flag 70 is retained therein by means of a pivot pin 76. A vertical slot 78 is formed in flag housing 72 and a handle bar 80 allows manipulation of the flag of preferred color upright into its notice position thereby to inform the mailman that the mailbox 12 includes pick-up material.

Figure 5:
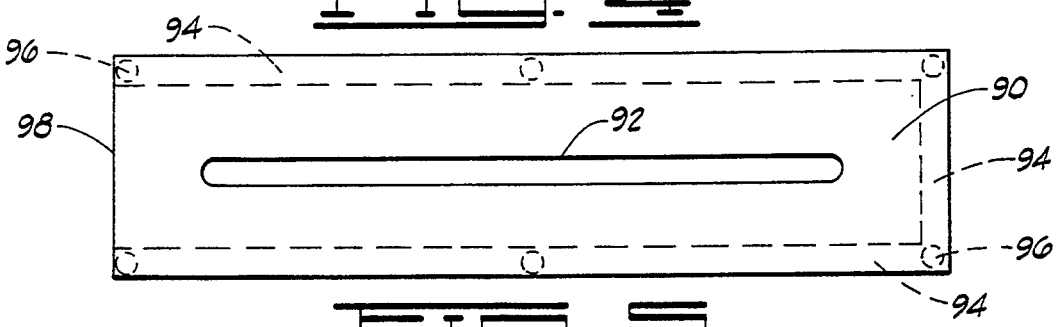
FIG. 5 is a plan view of an alternative form of flag housing that may be utilized with the mailbox assembly of FIGS. 1 and 2.
Figure 6:
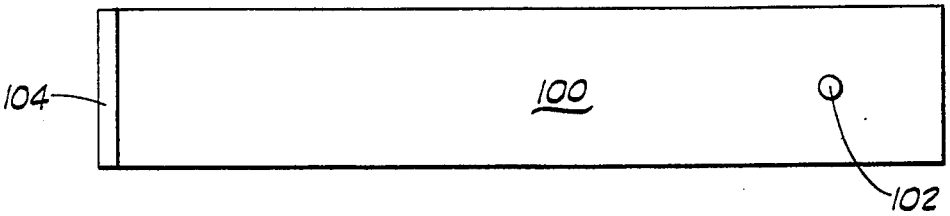
FIG. 6 is a plan view of a slidable mail flag that is used with the housing of FIG. 5.
Figure 7:
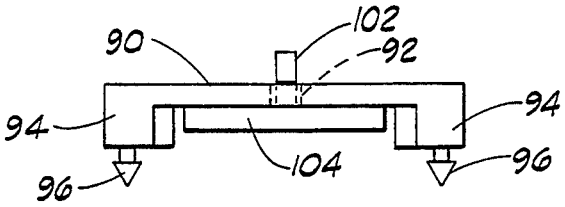
FIG. 7 is an end view of the housing of FIG. 5 including the mail flag of FIG. 6.

FIGS. 5, 6 and 7 illustrate an alternative form of flag device and flag housing of the horizontal slide type. Thus, a plastic flag housing 90 is formed as an elongate, rectangular housing having a longitudinal slot 92 and a seating bead 94 formed around three sides, said bead including arrow inserts 96 for snap-in affixture in designated holes (not shown). The flag housing 90 serves to define an entry end 98 into which is received a rectangular flag strip 100 of selected contrast color. The flat strip 100 is formed with a guide rod 102 which slides within groove 92 and a pull tab 104 may be provided on the outward end of flag strip 100. FIG. 7 shows an end view of the flag strip 100 when assembled operatively in flag housing 90.

Figure 8:
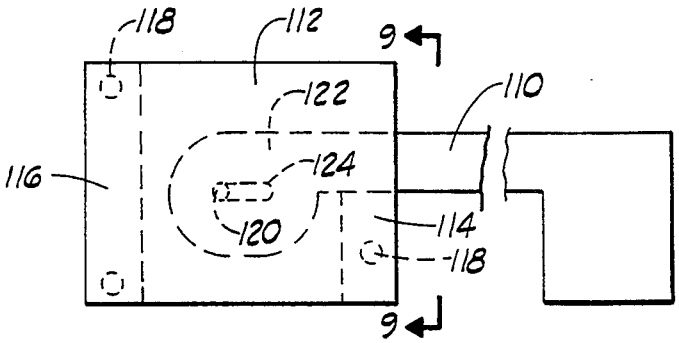
FIG. 8 is a plan view of yet another alternative form of flag assembly that may be used with the mailbox assemblies of FIGS. 1 and 2.
Figure 9:
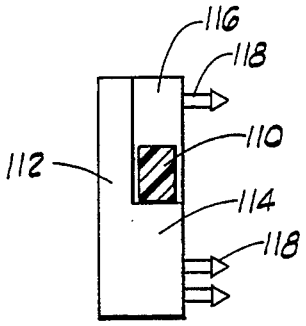
FIG. 9 is an end view taken along lines 9—9 of FIG. 8.

FIGS. 8 and 9 illustrate yet another form of flag attachment which is designed for snap-fit in the side panel 22 of the mailbox 12. A flag 110 is shown in its normal or down position in FIG. 8 as supported on a flag housing 112. The flag housing 112 is a generally square formation having a half bead 114 formed on one side while the opposite side includes a full bead 116 extending vertically. The beads include a plurality of insert arrows 118 which coact with aligned holes in the side of the mailbox 12 to provide mounting affixture. A pivot pin 120 supports a flag base 122 in a longitudinal slot 124. Thus, the flag 110, shown in the at rest position in FIG. 8, may be manually raised to the upright position in order to provide notice of mail pick-up.

In operation, the mailbox assembly 10 is put together in the manner shown in FIGS. 1 and 2 and the support post 14 is supported in its location with the anchor foot 16 and a portion of lower post section 44 retained in such as concrete. In the assembled condition, the tether 64 includes enough slack to allow considerable extension in the event that components are jolted apart by collision, vandalism or the like. In the assembled attitude, the mounting collar 30 is snap fit down over the upper end 46 of upper post section 40 and the annular ring 36 is snap-fit into the annular groove 48 in secure positioning. The remainder of the post sections 42 (one or more) and lower post section 44 are assembled telescopically to place the mailbox assembly 10 in its ready condition.

At collision or under effects of vandalism, the mailbox 12 and mounting collar 30 may be snapped loose and/or one or more of the telescopic interconnections between post sections 40, 42 and 44 may become separated but, nevertheless, all of the individual sections will be held intact by the tether 64. So long as the elements are all retained on tether 64, they may be readily reassembled by simply slide-fitting the respective post sections 40, 42 and 44 with subsequent snap-fit of the mailbox 12 and mounting collar 30. In addition to the ease with which the mailbox assembly 10 can be assembled and disassembled, it is also a significant attribute that the assembly 10 is formed from a plastic material that has little capability of scratching any exterior objects that may come in contact. Further, there are specific aesthetic advantages in that the mailbox and/or mounting post combination may utilize various plastic colorations, wood finish exteriors and the like to provide a visually appealing installation that is free from rust or fading discoloration.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A mailbox assembly that is highly resistant to destruction, comprising:

a mailbox formed from high strength plastic to have sides, top, bottom, rear and door panels, and having a securing eye formed on the bottom;

a mounting collar having a snap ring formed around the inner wall and being securely affixed in position to the mailbox bottom around said securing eye;

an upper post section having a lower end and upper end and a snap groove formed around the upper end for mating engagement with said mounting collar snap ring;

at least one post section having upper and lower ends and adapted for telescopic fit with said upper post section, and having a generally flat anchor foot formed across the lower end; and a tether connected between said mailbox securing eye and extending through said mounting collar, upper post section and at least one post section for securing at a point adjacent said anchor foot, said tether being of a length that allows significant slack when the mailbox is assembled.

2. A mailbox assembly as set forth in claim 1 wherein said at least one post section comprises:

plural post sections in telescopic mating engagement.

3. A mailbox assembly as set forth in claim 1 which further includes:

a flag housing having plural arrow inserts for snap-fit into one of said mailbox sides; and a color contrasting flag member pivotally fixed within said flag housing for selected visible positioning.

4. A mailbox assembly as set forth in claim 1 which further includes:

a flag housing having plural arrow inserts for snap-fit into one of said mailbox sides; and a color contrasting flag member supported in said flag housing and being longitudinally slidable forward into visible positioning.

5. A mailbox assembly as set forth in claim 1 which further includes:

a flag housing having plural arrow inserts for snap-fit into one side of the mailbox; and a color contrasting flag member pivotally fixed within said flag housing for selective positioning in vertical attitude.

6. A mailbox assembly as set forth in claim 1 wherein: said door panel is hinged about a horizontal axis at the bottom panel front.

7. A mailbox assembly as set forth in claim 1 wherein: said anchor foot is a flat panel that aids in resistive retention within cementitious mounting material.

* * * * *